US007667394B2

(12) United States Patent
Son et al.

(10) Patent No.: US 7,667,394 B2
(45) Date of Patent: Feb. 23, 2010

(54) DISPLAY APPARATUS

(75) Inventors: Seung-Hyun Son, Suwon-si (KR); Hyoung-Bin Park, Suwon-si (KR)

(73) Assignee: Samsung SDI Co., Ltd., Suwon-Si, Yeongtong-Gu (KR)

( * ) Notice: Subject to any disclaimer, the term of this patent is extended or adjusted under 35 U.S.C. 154(b) by 390 days.

(21) Appl. No.: 11/589,627

(22) Filed: Oct. 30, 2006

(65) Prior Publication Data

US 2007/0096645 A1 May 3, 2007

(30) Foreign Application Priority Data

Oct. 31, 2005 (KR) ..... 10-2005-0103435

(51) Int. Cl.
*H01J 1/62* (2006.01)

(52) U.S. Cl. ..... 313/506; 428/690

(58) Field of Classification Search ..... 313/499, 313/506, 586–587; 428/690
See application file for complete search history.

(56) References Cited

U.S. PATENT DOCUMENTS 6,838,816 B2 * 1/2005 Su et al. ..... 313/499
2002/0086181 A1 * 7/2002 Lee-Mi et al. ..... 428/690
2004/0174117 A1 * 9/2004 Han ..... 313/506
2006/0012304 A1 * 1/2006 Son et al. ..... 313/586

FOREIGN PATENT DOCUMENTS

JP 09-204889 8/1997
KR 1020020065968 A 8/2002

OTHER PUBLICATIONS

S. Komatsu, et al. 29a-YC-5 Electron field emission from self-organized micro-emitters of $sp^3$-bonded 5H boron nitride. NIMS. J.Phys. Chem.B103, 3289 (1999), APL.81, 4547(2002), J.Phys.Chem.B, Jan. 2004. Abstract in 1 page.

* cited by examiner

*Primary Examiner*—Mary Ellen Bowman
*Assistant Examiner*—Nimeshkumar D Patel
(74) *Attorney, Agent, or Firm*—Knobbe Martens Olson & Bear LLP

(57) ABSTRACT

Provided is a display apparatus that improves luminous efficiency and reduces a driving voltage. The display apparatus includes: a first electrode and a second electrode separated from each other; an electron accelerating layer interposed between the first and second electrodes and accelerating and emitting electrons when a voltage is applied between the first and second electrodes; and a light emitting layer interposed between the second electrode and the electron accelerating layer and producing visible rays by the electrons emitted from the electron accelerating layer.

17 Claims, 5 Drawing Sheets

DISPLAY APPARATUS

CROSS-REFERENCE TO RELATED APPLICATION

This application claims the priority of Korean Patent Application No. 10-2005-0103435, filed on Oct. 31, 2005, in the Korean Intellectual Property Office, the disclosure of which is incorporated herein in its entirety by reference.

BACKGROUND OF THE INVENTION

1. Field of the Invention

The present embodiments relate to a display apparatus having a new structure in which luminous efficiency is high and a driving voltage is low.

2. Description of the Related Art

Apparatuses using an inorganic electroluminescence device as apparatuses for displaying an image have been studied in various ways. A traditional structure of such an inorganic electroluminescence device is disclosed in U.S. Pat. Nos. 5,543,237 and 5,648,181. The inorganic electroluminescence device has a structure shown in FIG. 1. A transparent indium tin oxide (ITO) electrode 2 is formed on a substrate 1, and a first dielectric layer 3 is formed on the ITO electrode 2. An inorganic light emitting layer 4 in which electroluminescence occurs is formed on the first dielectric layer 2. A second dielectric layer 5 and a back electrode 6 are sequentially stacked on the inorganic light emitting layer 4. This stacked structure is isolated from the outside by a protective layer (not shown) to be formed on the back electrode 6. The inorganic electroluminescence device is driven by an alternating current (AC). An inorganic light emitting body collides with electrons accelerated by a high electric field, is excited and then stabilized, thereby producing visible rays for realizing an image. Thus, in order to achieve high efficiency, a large amount of electrons are accelerated with high energy so that a driving voltage is increased.

In addition, since a plasma display panel (PDP) requires high energy to ionize a discharge gas, the driving voltage is large and luminous efficiency is lowered.

SUMMARY OF THE INVENTION

The present embodiments provide a plasma display panel (PDP) having a new structure in which luminous efficiency is high and a driving voltage is low.

According to an aspect of the present embodiments, there is provided a display apparatus, the display apparatus including: a first electrode and a second electrode separated from each other; an electron accelerating layer interposed between the first and second electrodes and accelerating and emitting electrons when a voltage is applied between the first and second electrodes; and a light emitting layer interposed between the second electrode and the electron accelerating layer and producing visible rays by the electrons emitted from the electron accelerating layer.

According to another aspect of the present embodiments, there is provided a display apparatus, the display apparatus including: a first electrode and a second electrode separated from each other; an electron accelerating layer interposed between the first and second electrodes and accelerating and emitting electrons when a voltage is applied between the first and second electrodes; and a light emitting layer formed outside the second electrode and producing visible rays by the electrons emitted from the electron accelerating layer.

According to another aspect of the present embodiments, there is provided a display apparatus, the display apparatus including: a first substrate and a second substrate opposing each other; a first electrode and a second electrode formed between the first substrate opposing the second substrate and the second substrate to be separated from each other; a first electron accelerating layer and a second electron accelerating layer formed on the first and second electrodes, respectively, and accelerating and emitting electrons when a voltage is applied between the first and second electrodes; and a light emitting layer interposed between the first and second accelerating layers and producing visible rays by the electrons emitted from the first and second electron accelerating layers.

BRIEF DESCRIPTION OF THE DRAWINGS

The above and other aspects and advantages of the present embodiments will become more apparent by describing in detail exemplary embodiments thereof with reference to the attached drawings in which.

DETAILED DESCRIPTION OF THE INVENTION

Figure 1:
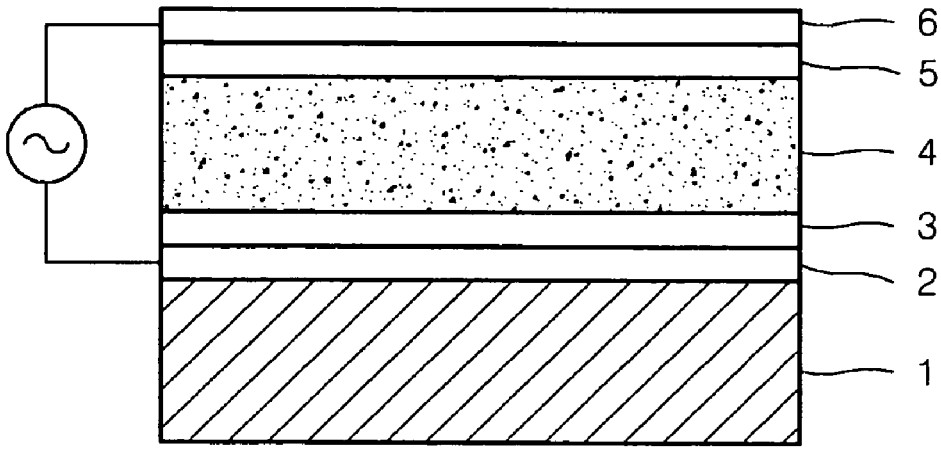
FIG. 1 is a schematic cross-sectional view of a conventional inorganic electroluminescence device.

The present embodiments will now be described more fully with reference to the accompanying drawings, in which exemplary embodiments are shown. Like reference numerals denote like elements.

Figure 2:
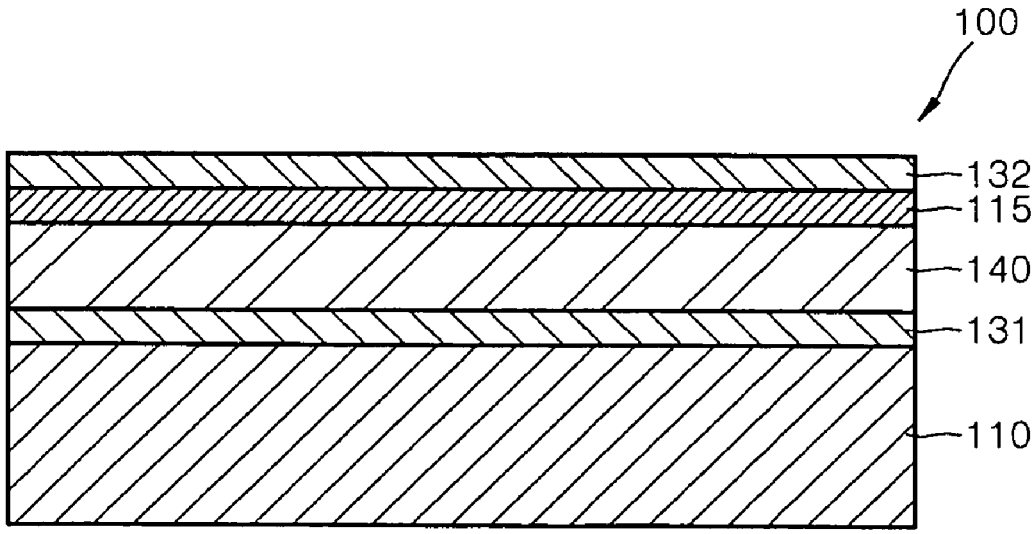
FIG. 2 is a schematic cross-sectional view of a display apparatus according to an embodiment.

FIG. 2 is a schematic cross-sectional view of a display apparatus 100 according to an embodiment. Referring to FIG. 2, a first electrode 131 is formed on a substrate 110. The substrate 110 may be, for example, a glass substrate having a high visible-rays transmission ratio and may also be colored for bright room contrast improvement. In addition, the substrate 110 can be formed of plastics and thus may have a flexible structure.

The first electrode 131 may be formed of a transparent conductive material, such as indium tin oxide (ITO) having a high visible-rays transmission ratio.

An electron accelerating layer 140 is formed on the first electrode 131. The electron accelerating layer 140 may be formed of a material that accelerates electrons, for example, oxidized porous silicon. Examples of the oxidized porous silicon include oxidized porous polysilicon and oxidized porous amorphous silicon. In addition, the electron accelerating layer 140 may include carbon nanotubes (CNTs) or boron nitride bamboo shoot (BNBS). Here, BNBS is the name of an $sp^3$ combination 5H-BN which has been developed by Japanese national institute for material science (NIMS) and published on March 2004 (29a-YC-5, Extended Abstract of Spring meeting of Japan Society of Applied Physics). It is well-known that this BNBS is very stable and has extreme hardness similar to the hardness of diamond. In addition, BNBS has a transparent property in the range of wavelength of about 380 to about 780 nm which is the visible rays region and has negative electron affinity and thus has a very excellent electron emission property.

A light emitting layer 115 is formed on the electron accelerating layer 140. The light emitting layer 115 is a material layer that produces visible rays by collision with electrons, and a detailed description thereof will be described later. The light emitting layer 115 may be formed of an inorganic material. However, the present embodiments are not limited to this and the light emitting layer 115 may include quantum dots. Characteristics of the quantum dots will now be described.

Figure 3:
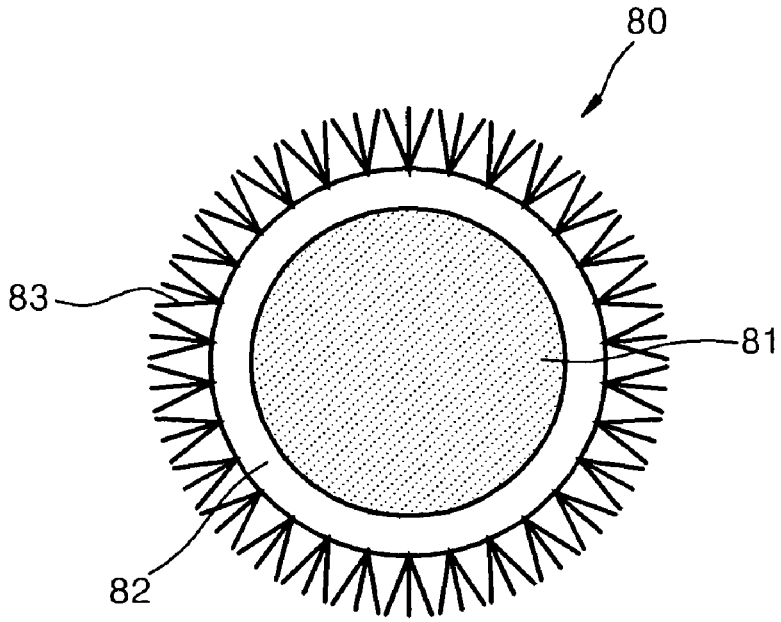
FIG. 3 is a schematic view of quantum dots.

Since atoms are aggregated in a solid emission material, an energy band is formed. In this case, in the solid emission material, electrons excited by an energy received from the outside are stabilized from a conduction band to a valence band so that visible rays corresponding to a difference between the conduction band and the valence band are produced. In the quantum dots, there is no interference between the atoms. Thus, if an energy is received from the outside, electrons excited at an atom energy level are stabilized and visible rays are produced. Thus, theoretical quantum efficiency of the quantum dots can be improved up to 100% and electrons can be excited even at a low voltage so that luminous efficiency can be improved. In addition, since a light emitting layer can be formed using a printing process, it is advantageous to make a display apparatus bigger. An example of a quantum dot is illustrated in FIG. 3. Referring to FIG. 3, a quantum dot 80 includes a core 81, a shell 82, and caps 83. CdSe can be used for the core 81. The shell 82 can be formed of ZnS and surrounds the core 81. The caps 83 can be formed of trioctylphosphine oxide (TOPO) and support the core 81 and the shell 82. The core 81, the shell 82, and the caps 83 can have a single layer structure or a multi-layer structure but may have a single layer structure for luminous efficiency.

Referring to FIG. 2, a second electrode 132 is formed on the light emitting layer 115. The second electrode 132 may extend to be parallel to the first electrode 131 or to cross it. The second electrode 132 may be formed of ITO or metal having high conductivity, such as copper. In addition, since the second electrode 132 has no direct relation with a visible-rays transmission ratio, the thickness of the second electrode 132 can be large and thus it is advantageous for an increased lifetime of the display apparatus.

The operation of the display apparatus 100 having the above structure will now be described. The case where the light emitting layer 115 is formed of an inorganic material will now be described.

Voltages having various shapes can be applied to the first electrode 131 and the second electrode 132. If voltages applied to the first electrode 131 and the second electrode 132 are $V_1$ and $V_2$, respectively, a predetermined voltage is applied to each of the first and second electrodes 131 and 132 so as to satisfy $V_1<V_2$. The voltages applied to the first electrode 131 and the second electrode 132 can be direct current (DC) voltages or alternating current (AC) voltages. If the voltages are applied to the display apparatus 100 and a strong electric field of more than 1MV/cm is formed due to the voltages applied to the first electrode 131 and the second electrode 132, electrons trapped at an interface level between the electron accelerating layer 140 and the light emitting layer 115 are emitted so that electrons are tunneled into the conduction band of the light emitting layer 115. In particular, according to the current embodiment, since the electrons are accelerated by the electron accelerating layer 140 and tunneled into the light emitting layer 115 with a large initial incident energy, luminous efficiency can be improved and the driving voltages applied to the first electrode 131 and the second electrode 132 can be reduced.

The electrons emitted into the conduction band of the light emitting layer 115 obtain a sufficient energy to be accelerated by an external electric field and to excite a light emitting center and then collide with the outermost electrons of the light emitting center, and the light emitting center is excited. At this time, the electrons in an excited state are stabilized to the base state from an excited state and visible rays are emitted due to the energy difference. In addition, part of the electrons with a high energy collide with a light emitting body and are ionized, thereby emitting secondary electrons. These electrons lose energy when colliding with the light emitting center. The primary electrons and secondary electrons which do not collide with the light emitting center move into a high energy state, and then excite a material of the light emitting center and are trapped at an interface level of the second electrode 132.

Even when the light emitting layer 115 includes quantum dots, the electrons accelerated and emitted from the electron accelerating layer 140 and having a high energy collide with the quantum dots so that the electrons of the quantum dots can be effectively excited. The excited electrons are stabilized and visible rays are produced. Thus, due to characteristics of the electron accelerating layer 140 and the quantum dots, luminous efficiency can be improved and the driving voltages applied to the first electrode 131 and the second electrode 132 can be reduced.

Figure 4:
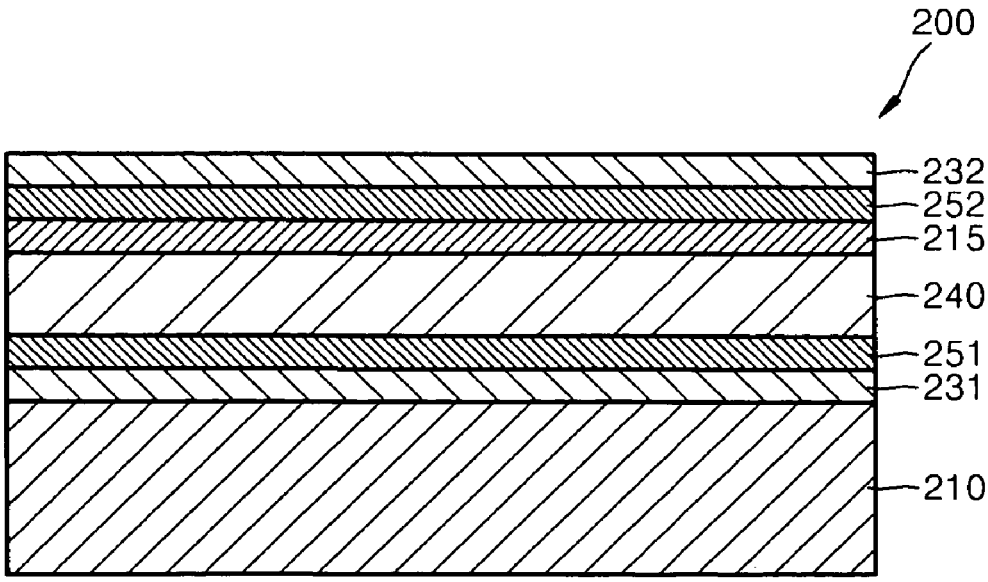
FIG. 4 is a schematic cross-sectional view of a display apparatus according to another embodiment.

FIG. 4 is a schematic partially cross-sectional view of a display apparatus 200 according to another embodiment. Referring to FIG. 4, a first electrode 231 is formed on a substrate 210. The first electrode 231 may be formed of a transparent conductive material, such as ITO having a high visible-rays transmission ratio.

A first dielectric layer 251 is formed on the first electrode 231. In addition, an electron accelerating layer 240 is formed on the first electrode 231. The electron accelerating layer 240 may include oxidized porous silicon. Examples of the oxidized porous silicon include oxidized porous polysilicon and oxidized porous amorphous silicon. In addition, the electron accelerating layer 240 may include carbon nanotubes (CNTs) or boron nitride bamboo shoot (BNBS).

A light emitting layer 215 is formed on the electron accelerating layer 240. The light emitting layer 215 may be formed of an inorganic material or a material including quantum dots.

A second dielectric layer 252 is formed on the light emitting layer 215. In addition, a second electrode 232 is formed on the second dielectric layer 252. The second electrode 232 may extend to be parallel to the first electrode 231 or to cross it. The second electrode 232 may be formed of ITO or metal having high conductivity, such as copper.

Voltages having various shapes can be applied to the first electrode 231 and the second electrode 232. If voltages applied to the first electrode 231 and the second electrode 232 are $V_1$ and $V_2$, respectively, a predetermined voltage is applied to each of the first and second electrodes 231 and 232 so as to satisfy $V_1<V_2$. The voltages applied to the first electrode 231 and the second electrode 232 can be direct current (DC) voltages or alternating current (AC) voltages. If the voltages are applied to the display apparatus 200 and a strong electric field of more than 1 MV/cm is formed due to the voltages applied to the first electrode 231 and the second electrode 232, electrons are accelerated inside the electron accelerating layer 240 and incident on the light emitting layer 215. The electrons excite the light emitting layer 215 and the light emitting layer 215 is stabilized so that visible rays are produced. At this time, since due to the electron accelerating layer 240, the energy level of the electrons incident on the light emitting layer 215 is high, luminous efficiency can be improved and the driving voltages applied to the first electrode 231 and the second electrode 232 can be reduced. In particular, when the second electrode 232 is in a grounded state, the electrons which transmit the light emitting layer 215 and the second dielectric layer 252 can be emitted.

Figure 5:
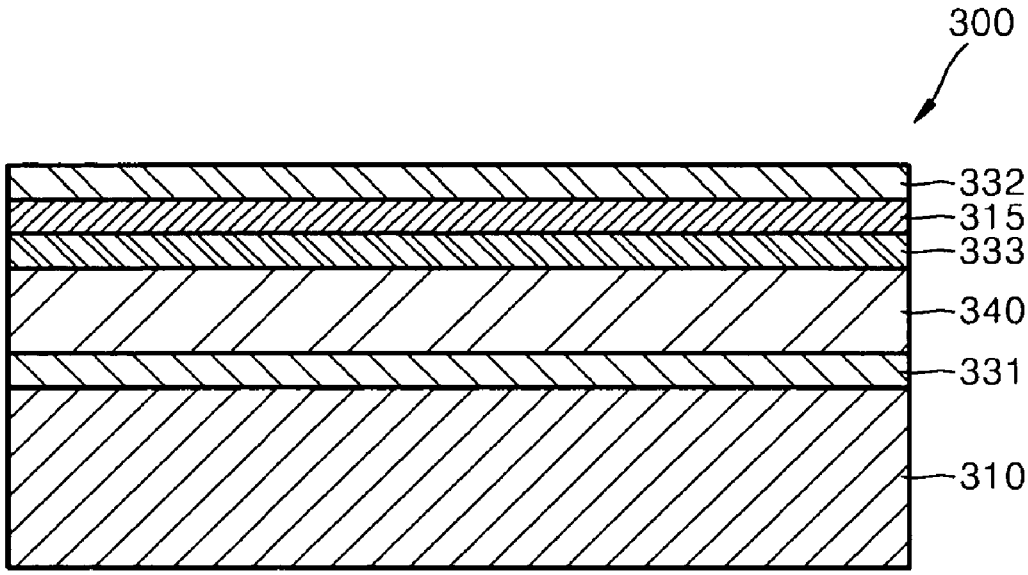
FIG. 5 is a schematic cross-sectional view of a display apparatus according to another embodiment.

FIG. 5 is a schematic partially cross-sectional view of a display apparatus 300 according to another embodiment. Referring to FIG. 5, a first electrode 331 is formed on a substrate 310. The first electrode 331 may be formed of a transparent conductive material, such as ITO having a high visible-rays transmission ratio.

An electron accelerating layer 340 is formed on the first electrode 331. The electron accelerating layer 340 may be an insulating layer. A third electrode 333 is formed on the electron accelerating layer 340. The third electrode 333 may be formed of a transparent conductive material, such as ITO having a high visible-rays transmission ratio. The first electrode 331, the electron accelerating layer 340, and the third electrode 333 constitute a metal-insulator-metal (MIM) structure.

A light emitting layer 315 is formed on the electron accelerating layer 340. The light emitting layer 315 may be formed of an inorganic material or a material including quantum dots.

A second electrode 332 is formed on the light emitting layer 315. The second electrode 332 may extend to be parallel to the first electrode 331 or to cross it. The second electrode 332 may be formed of ITO or metal having high conductivity, such as copper.

Voltages having various shapes can be applied to the first electrode 331, the second electrode 332, and the third electrode 333. If voltages applied to the first electrode 331, the second electrode 332, and the third electrode 333 are $V_1$, $V_2$, and $V_3$, respectively, a predetermined voltage is applied to each of the first, second, and third electrodes 331, 332, and 333 so as to satisfy $V_1<V_3\leqq V_2$. The voltages applied to the first electrode 331, the second electrode 332, and the third electrode 333 can be direct current (DC) voltages or alternating current (AC) voltages. If the voltages are applied to the display apparatus 300, electrons starting from the first electrode 331 tunnel the electron accelerating layer 340 and are accelerated and then pass through the third electrode 333 and are incident on the light emitting layer 315. The electrons excite the light emitting layer 315 and the light emitting layer 315 is stabilized so that visible rays are produced. At this time, since due to the electron accelerating layer 340, the energy level of the electrons incident on the light emitting layer 315 is high, luminous efficiency can be improved and the driving voltages applied to the first electrode 331, the second electrode 332, and the third electrode 333 can be reduced. In particular, when the second electrode 332 is in a grounded state, the electrons which transmit the light emitting layer 315 can be emitted.

Figure 6:
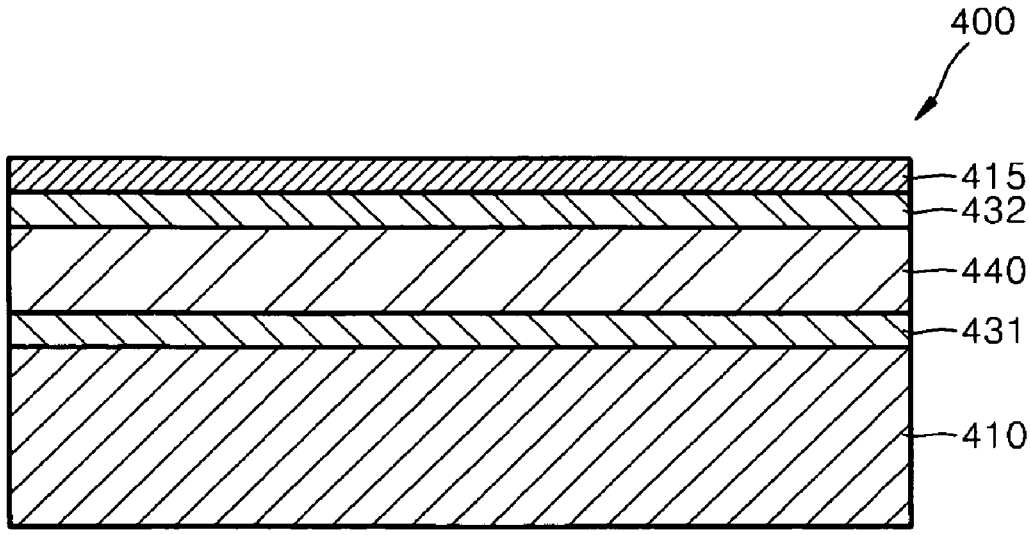
FIG. 6 is a schematic cross-sectional view of a display apparatus according to another embodiment.

FIG. 6 is a schematic partially cross-sectional view of a display apparatus 400 according to another embodiment. Referring to FIG. 6, a first electrode 431 is formed on a substrate 410. The first electrode 431 may be formed may be formed of a transparent conductive material, such as ITO having a high visible-rays transmission ratio.

An electron accelerating layer 440 is formed on the first electrode 431. The electron accelerating layer 440 may include oxidized porous silicon. Examples of oxidized porous silicon include oxidized porous poly silicon and oxidized porous amorphous silicon. In addition, the electron accelerating layer 440 may include carbon nanotubes (CNTs) or boron nitride bamboo shoot (BNBS).

A second electrode 432 is formed on the electron accelerating layer 440. The second electrode 432 may extend to be parallel to the first electrode 431 or to cross it. When the electron accelerating layer 440 is an insulating layer, the first electrode 431, the electron accelerating layer 440, and the second electrode 432 constitute an MIM structure.

A light emitting layer 415 is formed on the second electrode 432. The light emitting layer 415 may be formed of an inorganic material or a material including quantum dots.

Voltages having various shapes can be applied to the first electrode 431 and the second electrode 432. If voltages applied to the first electrode 431 and the second electrode 432 are $V_1$ and $V_2$, respectively, a predetermined voltage is applied to each of the first and second electrodes 431 and 432 so as to satisfy $V_1<V_2$. The voltages applied to the first electrode 431 and the second electrode 432 can be direct current (DC) voltages or alternating current (AC) voltages. If the voltages are applied to the display apparatus 400, due to the voltages applied to the first electrode 431 and the second electrode 432, electrons are accelerated inside the electron accelerating layer 440 and incident on the light emitting layer 415. The electrons excite the light emitting layer 415 and the light emitting layer 415 is stabilized so that visible rays are produced. At this time, since due to the electron accelerating layer 440, the energy level of the electrons incident on the light emitting layer 415 is high, luminous efficiency can be improved and the driving voltages applied to the first electrode 431 and the second electrode 432 can be reduced.

Figure 7:
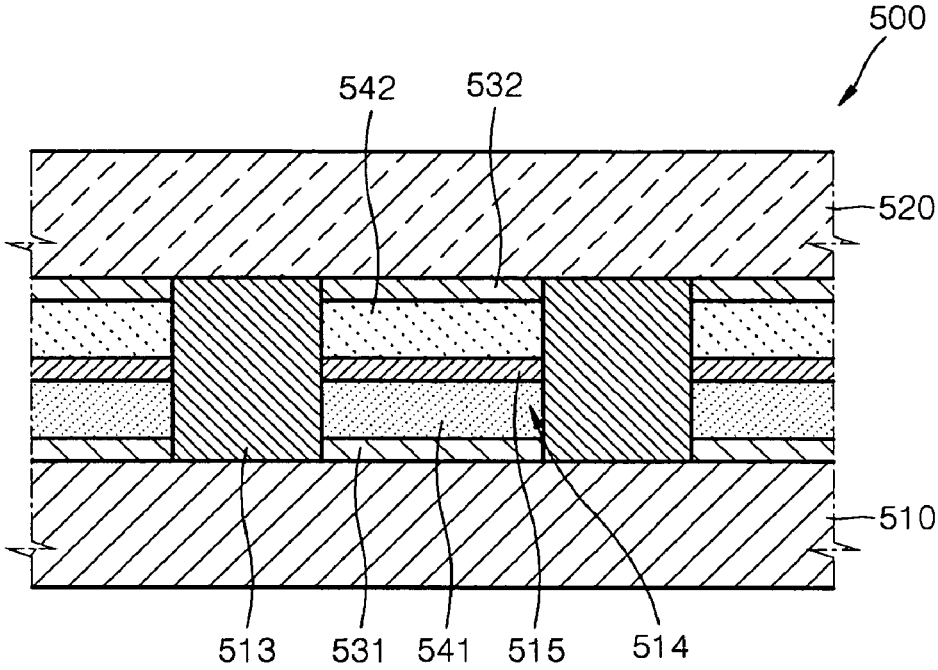
FIG. 7 is a schematic cross-sectional view of a display apparatus according to another embodiment.

FIG. 7 is a schematic partially cross-sectional view of a display apparatus 500 according to another embodiment. Referring to FIG. 7, a first substrate 510 and a second substrate 520 are opposed to each other at predetermined intervals. A plurality of barrier ribs 513 are disposed between the first substrate 510 and the second substrate 520 and form a plurality of cells 514 by partitioning a space between the first substrate 510 and the second substrate 520.

First electrodes 532 are disposed on the first substrate 510 that opposes the second substrate 520. In addition, second electrodes 532 are disposed on the second substrate 520 that opposes the first substrate 510. In FIG. 7, the first electrodes 531 extend to be parallel to the second electrodes 532. However, the present embodiments are not limited to this and the first electrodes 531 may extend to cross the second electrodes 532.

First electron accelerating layers 541 and second electron accelerating layers 542 are disposed on the first electrodes 531 and the second electrodes 532, respectively. The first electron accelerating layers 541 and the second electron accelerating layers 542 may include oxidized porous silicon. Examples of oxidized porous silicon include oxidized porous poly silicon and oxidized porous amorphous silicon. In addition, the first electron accelerating layers 541 and the second electron accelerating layers 542 may include CNTs or BNBS.

Light emitting layers 515 are formed between the first electron accelerating layers 541 and the second electron accelerating layers 542. The light emitting layers 515 may directly contact one of the first electron accelerating layers 541 or the second electron accelerating layers 542. However, the light emitting layers 515 may closely contact the first electron accelerating layers 541 and the second electron accelerating layers 542 for luminous efficiency. The light emitting layers 515 may be formed of an inorganic material or a material including quantum dots.

In FIG. 7, both side surfaces of each of the first electrodes 531, the second electrodes 532, the first electron accelerating layers 541, the second electron accelerating layers 542, and the light emitting layers 515 contact the barrier ribs 513 but the present embodiments are not limited to this.

Voltages having various shapes can be applied to the first electrodes 531 and the second electrodes 532. If voltages applied to the first electrodes 531 and the second electrodes 532 are $V_1$ and $V_2$, respectively, AC power is applied to $V_1$ and $V_2$. If the voltages are applied to the display apparatus 500, due to the voltages applied to the first electrodes 531 and the second electrodes 532, electrons are accelerated inside the first electron accelerating layers 541 and the second electron accelerating layers 542 and incident on the light emitting layers 515. The electrons excite the light emitting layers 515 and the light emitting layers 515 are stabilized so that visible rays are produced. At this time, since due to the first electron accelerating layers 541 and the second electron accelerating layers 542, the energy level of the electrons incident on the light emitting layers 515 is high, luminous efficiency can be improved and the driving voltages applied to the first electrode 531 and the second electrode 532 can be reduced.

Figure 8:
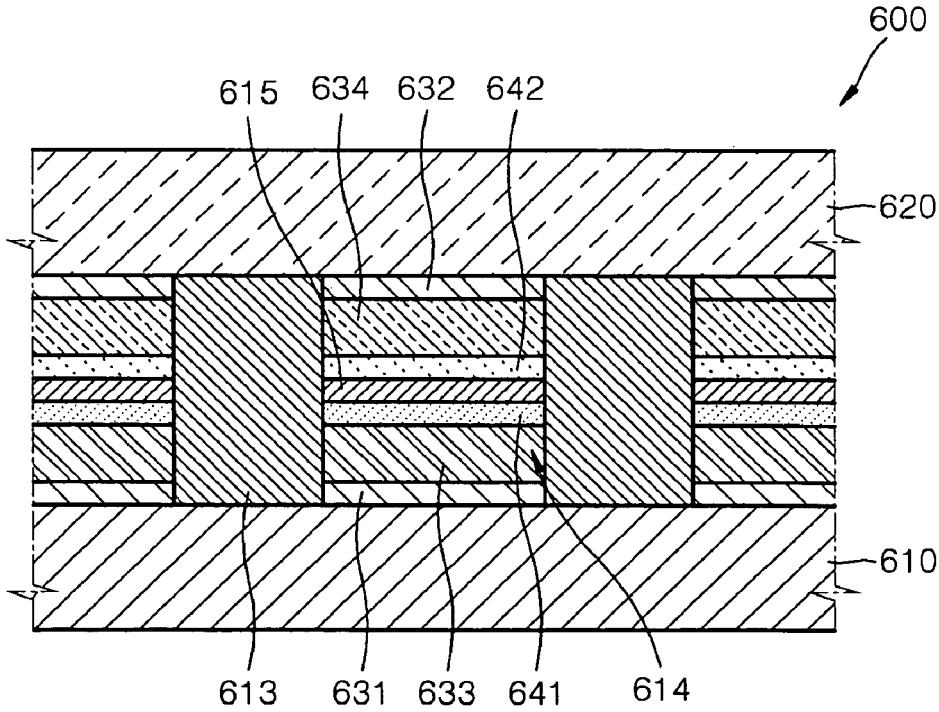
FIG. 8 is a schematic cross-sectional view of a display apparatus according to another embodiment.

FIG. 8 is a schematic partially cross-sectional view of a display apparatus 600 according to another embodiment. Referring to FIG. 8, a first substrate 610 and a second substrate 620 are opposed to each other at predetermined intervals. A plurality of barrier ribs 613 are disposed between the first substrate 610 and the second substrate 620 and form a plurality of cells 614 by partitioning a space between the first substrate 610 and the second substrate 620.

First electrodes 631 are disposed on the first substrate 610 that opposes the second substrate 620. In addition, second electrodes 632 are disposed on the second substrate 620 that opposes the first substrate 610. In FIG. 8, the first electrodes 631 extend to be parallel to the second electrodes 632. However, the present embodiments are not limited to this and the first electrodes 631 may extend to cross the second electrodes 632.

First dielectric layers 633 and second dielectric layers 634 are disposed on the first electrodes 631 and the second electrodes 632, respectively. In addition, first electron accelerating layers 641 and second electron accelerating layers 642 are disposed on the first dielectric layers 633 and the second dielectric layers 634, respectively. The first electron accelerating layers 641 and the second electron accelerating layers 642 may include oxidized porous silicon. Examples of oxidized porous silicon include oxidized porous poly silicon and oxidized porous amorphous silicon. In addition, the first electron accelerating layers 641 and the second electron accelerating layers 642 may include CNTs or BNBS.

Light emitting layers 615 are formed between the first electron accelerating layers 641 and the second electron accelerating layers 642. The light emitting layers 615 may directly contact one of the first electron accelerating layers 641 or the second electron accelerating layers 642. However, the light emitting layers 615 may closely contact the first electron accelerating layers 641 and the second electron accelerating layers 642 for luminous efficiency. The light emitting layers 615 may be formed of an inorganic material or a material including quantum dots.

In FIG. 8, both side surfaces of each of the first electrodes 631, the second electrodes 632, the first dielectric layers 633, the second dielectric layers 634, the first electron accelerating layers 641, the second electron accelerating layers 642, and the light emitting layers 615 contact the barrier ribs 613 but the present embodiments are not limited to this.

Voltages having various shapes can be applied to the first electrodes 631 and the second electrodes 632. If voltages applied to the first electrodes 631 and the second electrodes 632 are $V_1$ and $V_2$, respectively, AC power is applied to $V_1$ and $V_2$. If the voltages are applied to the display apparatus 500, due to the voltages applied to the first electrodes 631 and the second electrodes 632, electrons are accelerated inside the first electron accelerating layers 641 and the second electron accelerating layers 642 and incident on the light emitting layers 615. The electrons excite the light emitting layers 615 and the light emitting layers 615 are stabilized so that visible rays are produced. At this time, since due to the first electron accelerating layers 641 and the second electron accelerating layers 642, the energy level of the electrons incident on the light emitting layers 615 is high, luminous efficiency can be improved and the driving voltages applied to the first electrode 631 and the second electrode 632 can be reduced.

Figure 9:
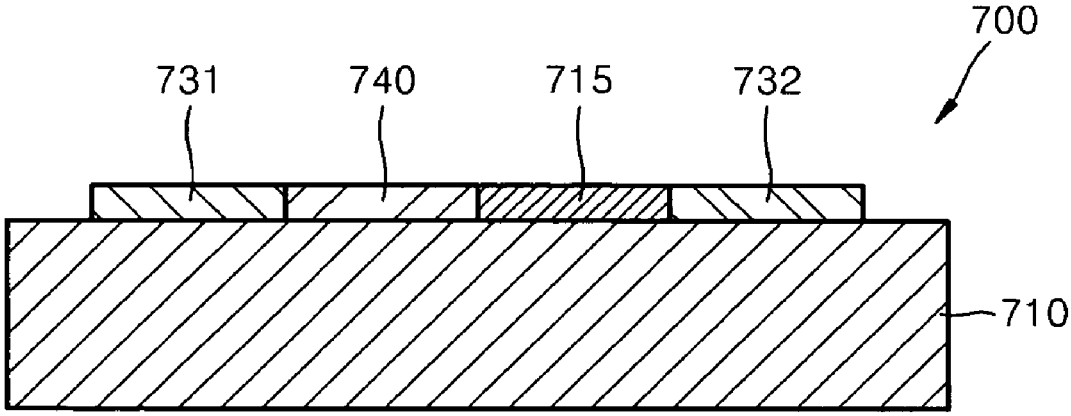
FIG. 9 is a schematic cross-sectional view of a display apparatus according to another embodiment.

FIG. 9 is a schematic partially cross-sectional view of a display apparatus 700 according to another embodiment. Referring to FIG. 9, a first electrode 731 is formed on a substrate 710. The first electrode 731 may be formed of one or various metals having high conductivity.

An electron accelerating layer 740 is formed on a side surface of the first electrode 731. The electron accelerating layer 740 includes oxidized porous silicon. Examples of the oxidized porous silicon include oxidized porous poly silicon and oxidized porous amorphous silicon. In addition, the electron accelerating layer 740 may include CNTs or BNBS.

A light emitting layer 715 is formed on a side surface of the electron accelerating layer 740. The light emitting layer 715 may be formed of an inorganic material or a material including quantum dots.

A second electrode 732 is formed on a side surface of the light emitting layer 715. The second electrode 732 may extend to be parallel to the first electrode 731 or to cross it. The second electrode 732 may be formed of ITO and/or metal having high conductivity, such as copper.

Voltages having various shapes can be applied to the first electrode 731 and the second electrode 732. If voltages applied to the first electrode 731 and the second electrode 732 are $V_1$ and $V_2$, respectively, a predetermined voltage is applied to each of the first and second electrodes 731 and 732 so as to satisfy $V_1<V_2$. The voltages applied to the first electrode 731 and the second electrode 732 can be direct current (DC) voltages or alternating current (AC) voltages. If the voltages are applied to the display apparatus 700, due to the voltages applied to the first electrode 731 and the second electrode 732, electrons are accelerated inside the electron accelerating layer 740 and incident on the light emitting layer 715. The electrons excite the light emitting layer 715 and the light emitting layer 715 is stabilized so that visible rays are produced. At this time, since due to the electron accelerating layer 740, the energy level of the electrons incident on the light emitting layer 715 is high, luminous efficiency can be improved and the driving voltages applied to the first electrode 731 and the second electrode 732 can be reduced. In particular, when the second electrode 732 is in a grounded state, the electrons which transmit the light emitting layer 715 can be emitted.

In the display apparatus 700 having the above structure, its thickness can be remarkably reduced. In addition, since the first electrode 731 and the second electrode 732 do not disturb a path of visible rays, they can also be formed of metal having high conductivity, such as copper, instead of ITO.

As described above, in the display apparatus according to the present embodiments, since electrons are accelerated by the electron accelerating layer and are incident on the light emitting layer, luminous efficiency can be improved and driving voltages can be reduced. In addition, since the display apparatus has a simple structure that can be easily made large, it can be applied to large display apparatuses or backlights.

While the present embodiments have been particularly shown and described with reference to exemplary embodiments thereof, it will be understood by those of ordinary skill in the art that various changes in form and details may be made therein without departing from the spirit and scope of the present embodiments as defined by the following claims.

What is claimed is:

1. A display apparatus comprising:

a first electrode and a second electrode separated from each other;

an electron accelerating layer interposed between the first and second electrodes configured to accelerate and emit electrons when a voltage is applied between the first and second electrodes;

a light emitting layer interposed between the second electrode and the electron accelerating layer configured to produce visible rays by the electrons emitted from the electron accelerating layer;

wherein the electron accelerating layer comprises at least one material selected from the group consisting of oxidized porous silicon and boron nitride bamboo shoot (BNBS) and wherein the light emitting layer comprises quantum dots.

2. The display apparatus of claim 1, further comprising a third electrode interposed between the electron accelerating layer and the light emitting layer, wherein the electron accelerating layer is an insulating layer.

3. The display apparatus of claim 1, wherein the light emitting layer includes an inorganic material.

4. The display apparatus of claim 1, further comprising:

a first dielectric layer interposed between the first electrode and the electron accelerating layer; and a second dielectric layer interposed between the second electrode and the light emitting layer.

5. The display apparatus of claim 1, further comprising a substrate on which the first electrode is formed.

6. The display apparatus of claim 1, wherein, wherein the voltage applied to the first electrode is less than the voltage applied to the second electrode.

7. A display apparatus comprising:

a first electrode and a second electrode separated from each other;

an electron accelerating layer interposed between the first and second electrodes configured to accelerate and emit electrons when a voltage is applied between the first and second electrodes;

a light emitting layer formed outside the second electrode configured to produce visible rays by the electrons emitted from the electron accelerating layer;

wherein the electron accelerating layer comprises at least one material selected from the group consisting of oxidized porous silicon and boron nitride bamboo shoot (BNBS) and wherein the light emitting layer comprises quantum dots.

8. The display apparatus of claim 7, wherein the electron accelerating layer is an insulating layer.

9. The display apparatus of claim 7, wherein the light emitting layer includes an inorganic material.

10. The display apparatus of claim 7, further comprising a substrate on which the first electrode is formed.

11. The display apparatus of claim 7, wherein, when voltage applied to the first electrode is less than the voltage applied to the second electrode.

12. A display apparatus comprising:

a first substrate and a second substrate opposing each other;

a first electrode and a second electrode formed between the first substrate opposing the second substrate and the second substrate separated from each other;

a first electron accelerating layer and a second electron accelerating layer formed on the first and second electrodes, respectively, configured to accelerate and emit electrons when a voltage is applied between the first and second electrodes;

a light emitting layer interposed between the first and second accelerating layers configured to produce visible rays by the electrons emitted from the first and second electron accelerating layers;

wherein the electron accelerating layer comprises at least one material selected from the group consisting of oxidized porous silicon and boron nitride bamboo shoot (BNBS) and wherein the light emitting layer comprises quantum dots.

13. The display apparatus of claim 12, further comprising:

a third electrode interposed between the first electron accelerating layer and the light emitting layer; and a fourth electrode interposed between the second electron accelerating layer and the light emitting layer, wherein the first electron accelerating layer and the second electron accelerating layer are insulating layers.

14. The display apparatus of claim 12, wherein the light emitting layer includes an inorganic material.

15. The display apparatus of claim 12, further comprising:

a first dielectric layer interposed between the first electrode and the first electron accelerating layer; and a second dielectric layer interposed between the second electrode and the second electron accelerating layer.

16. The display apparatus of claim 12, wherein the first electron accelerating layer, the light emitting layer, and the second electron accelerating layer closely contact one another and are stacked on the first and second substrates.

17. The display apparatus of claim 12, wherein alternating current power is applied to the first and second electrodes.

* * * * *